US008602776B2

(12) United States Patent
Stadeker

(10) Patent No.: US 8,602,776 B2
(45) Date of Patent: Dec. 10, 2013

(54) DEVICES AND METHODS FOR IMPROVED INTERDENTAL CLEANING AND THERAPY

(76) Inventor: Wilkie J. Stadeker, Marietta, GA (US)

( * ) Notice: Subject to any disclaimer, the term of this patent is extended or adjusted under 35 U.S.C. 154(b) by 38 days.

(21) Appl. No.: 12/613,315

(22) Filed: Nov. 5, 2009

(65) Prior Publication Data

US 2011/0099735 A1 May 5, 2011

(51) Int. Cl.
*A61C 3/00* (2006.01)

(52) U.S. Cl.
USPC ..... 433/141

(58) Field of Classification Search
USPC ..... 433/80, 90, 141, 216; 15/167.1–167.2; 132/321, 329
See application file for complete search history.

(56) References Cited

U.S. PATENT DOCUMENTS

| | | | | | |
|---|---|---|---|---|---|
| 4,805,646 | A | * | 2/1989 | Shimenkov | 132/329 |
| 4,863,380 | A | * | 9/1989 | Creed | 433/89 |
| 5,006,004 | A | | 4/1991 | Dirksing et al. | |
| 5,283,924 | A | | 2/1994 | Kaminski | |
| 5,476,384 | A | * | 12/1995 | Giuliani et al. | 433/216 |
| 5,775,346 | A | * | 7/1998 | Szyszkowski | 132/329 |
| 5,816,804 | A | * | 10/1998 | Fischer | 433/90 |
| 5,829,976 | A | * | 11/1998 | Green | 433/89 |
| 6,163,918 | A | | 12/2000 | Weihrauch | |
| 6,168,434 | B1 | | 1/2001 | Bohm-Van Diggelen | |
| 6,391,445 | B1 | | 5/2002 | Weihrauch | |
| 6,669,475 | B2 | * | 12/2003 | Kandelman et al. | 433/89 |
| 2003/0108846 | A1 | * | 6/2003 | Hoertsch | 433/216 |
| 2003/0198918 | A1 | * | 10/2003 | Dragan et al. | 433/90 |

* cited by examiner

*Primary Examiner* — Robyn Doan
*Assistant Examiner* — Matthew Nelson
(74) *Attorney, Agent, or Firm* — Thomas Horstemeyer, LLP

(57) ABSTRACT

The present invention relates to certain interdental cleaning devices and methods for their manufacture and use to remove interdental debris, to alleviate and/or prevent gingival inflammation, and or to deliver desired pharmacological and therapeutic or other active agents to the gingival or tooth surfaces. The pharmacologic and therapeutic agents of the present invention include, but are not limited to, antibiotics, antiseptics, anesthetics, astringents, and whitening agents. The present invention also includes various methods for the manufacture and use of interdental cleaning devices comprising a porous structural component that may be used to topically or locally deliver the pharmacologic and therapeutic agents according to the present invention to a desired target tissue within a mammalian body such as the interdental space to reduce or treat gingival infection, inflammation, or pain. The present invention further includes various methods for the manufacture and use of interdental cleaning devices comprising a porous structural component that may be used to topically or locally apply negative pressure to remove debris from the interdental space.

5 Claims, 6 Drawing Sheets

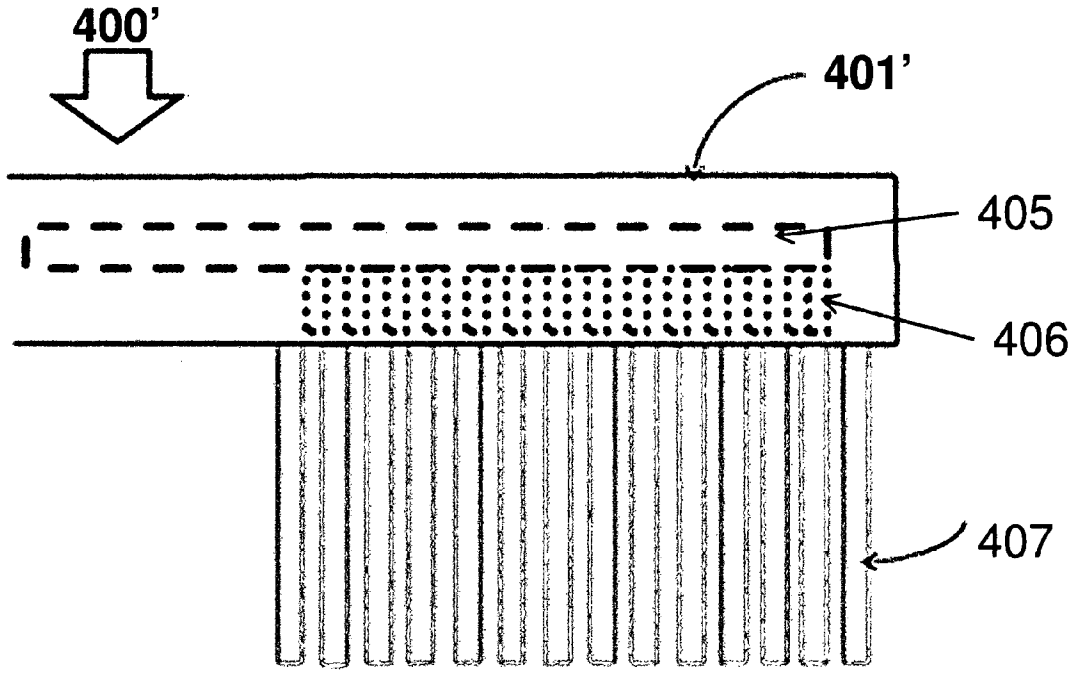
FIG. 4D
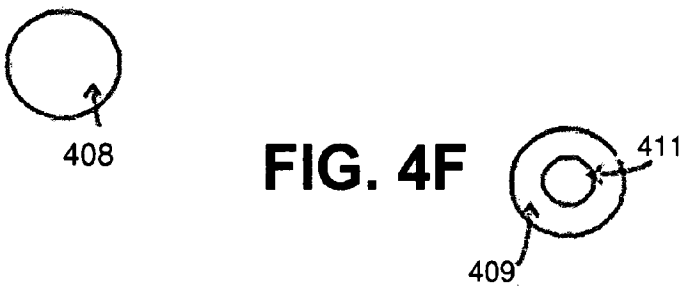
FIG. 4E
FIG. 4F
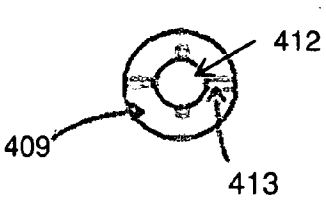
FIG. 4G

DEVICES AND METHODS FOR IMPROVED INTERDENTAL CLEANING AND THERAPY

FIELD OF THE INVENTION

The present invention relates to the fields of the life sciences, and more particularly dentistry and provides improved devices and methods to effect better interdental cleaning. More specifically, the present invention is directed to certain novel devices and methods for their use in interdental cleaning, including the ability to deliver pharmaceutical or other agents for topical or local administration to enhance cleaning and promote desired pharmacologic effects in the targeted interdental tissue.

BACKGROUND OF THE INVENTION

Deposits of bacteria upon the teeth (so-called dental plaque) are the cause of caries as well as teeth-loosening diseases (periodontitis). The deposits of bacteria are collected where they are best protected from the action of the chewing friction and the cleaning by the conventional tooth brush. It has also been established that the greatest loss of tooth attachment tissue takes place in the dental interspaces. As a rule, the most severe caries damage is present upon tooth faces adjacent to the dental interspaces.

In a vertical cross-sectional view the dental interspace takes the general shape of an isosceles triangle, the base of which is considerably shorter than the sides thereof. In a horizontal cross-sectional view the dental interspace is generally shaped as an hourglass on account of the round or oval cross-section of the teeth. Young persons with sound gums have their dental interspaces almost completely filled out by the gum papilla. These persons usually clean the tooth faces next to the interspace by means of a tooth thread or dental floss or a triangular pointed tooth pick which in this case has a sufficient cleaning effect.

On the other hand, if gum inflammation proceeds into teeth loosening, the mandible and other attachments of the tooth start deteriorating towards the tip of the tooth root. The gum papilla disappears and the dental interspace, triangular in the vertical cross-section, is laid bare. In these cases, a so-called interdental brush has been used hitherto as means for cleaning the dental interspaces. Such a brush resembles a bottle-brush, i.e. it is of even width and circular cross-section. The round core consists of metal threads twisted together and grasping the brush bristles projecting in all directions. It is self-evident that a round brush bristle or rounded toothpick is suboptimal for efficient cleaning of the triangular dental interspaces.

Prior art interdental cleaning devices include various known designs for tooth brushes, toothpicks, and water jet devices provided to clean the interdental spaces of debris that might lead to plaque formation and periodontal inflammation if left in place. In the known prior art, tooth brushes are generally provided with solid bristles, most commonly of nylon monofilament construction. Other solid polymers and natural fibers have also been used for bristles in prior art tooth brush design. Similarly, while toothpicks and similar interdental cleaners have been described with non-rounded cross-sectional structures, the prior art devices are disclosed and used only with solid structure designs of wood, plastics, and various other materials.

It would be useful, therefore, for an interdental cleaning device to be provided with a porous cleaning surface that may be adapted to better clean the interdental spaces. Such porous interdental cleaners may also be used to deliver pharmaceutical or other active agents to the interdental space to provide desired local therapy for conditions within the interdental spaces.

SUMMARY OF THE INVENTION

The present invention relates to certain interdental cleaning devices and methods for their manufacture and use to remove interdental debris, to alleviate and/or prevent gingival inflammation, and or to deliver desired pharmacological and therapeutic or other active agents to the gingival or tooth surfaces. The pharmacologic and therapeutic agents of the present invention include, but are not limited to, antibiotics, antiseptics, anesthetics, astringents, and whitening agents.

The present invention also includes various methods for the manufacture and use of interdental cleaning devices comprising a porous structural component that may be used to topically or locally deliver the pharmacologic and therapeutic agents according to the present invention to a desired target tissue within a mammalian body such as the interdental space to reduce or treat gingival infection, inflammation, or pain.

The present invention further includes various methods for the manufacture and use of interdental cleaning devices comprising a porous structural component that may be used to topically or locally apply negative pressure to remove debris from the interdental space.

BRIEF DESCRIPTION OF THE DRAWINGS

FIG. 4D is a side perspective view of an exemplary toothbrush embodiment of an interdental cleaner of the present invention in which the toothbrush body comprises a longitudinally continuous lumen.

FIG. 4E is a cross-sectional view of an exemplary embodiment of an entirely porous bristle of the exemplary toothbrush embodiment of an interdental cleaner of the present invention shown in FIG. 4D.

FIG. 4F is a cross-sectional view of an exemplary embodiment of a bristle of the exemplary toothbrush embodiment of an interdental cleaner of the present invention shown in FIG. 4D in which the bristle comprises a porous covering and a solid or tubular core.

FIG. 4G is a cross-sectional view of an exemplary embodiment of a bristle of the exemplary toothbrush embodiment of an interdental cleaner of the present invention shown in FIG. 4D in which the bristle comprises a porous covering for a tubular bristle core with a plurality of bristle ports.

DETAILED DESCRIPTION OF PREFERRED EMBODIMENTS

The present invention may be understood more readily by reference to the following detailed description of the preferred embodiments of the invention and the examples included herein. However, before the preferred embodiments of the devices and methods according to the present invention are disclosed and described, it is to be understood that this invention is not limited to the exemplary embodiments described within this disclosure, and the numerous modifications and variations therein that will be apparent to those skilled in the art remain within the scope of the invention disclosed herein. It is also to be understood that the terminology used herein is for the purpose of describing specific embodiments only and is not intended to be limiting.

Unless otherwise noted, the terms used herein are to be understood according to conventional usage by those of ordinary skill in the relevant art. In addition to the definitions of terms provided below, it is to be understood that as used in the specification and in the claims, "a" or "an" can mean one or more, depending upon the context in which it is used.

In various embodiments of the present invention, an interdental cleaner comprises a handle and an interdental body, said handle configured to provide a desired ergonomic interface for a user, and said interdental body configured to allow optimal access to the anatomic inter-proximal area in and between the teeth and further comprising one or more porous interfaces. The porous interfaces are designed to provide a gentle but minimally abrasive contact surface for interdental mechanical cleaning, provide an absorbent cleaning surface at the interdental interface to allow removal of dental plaque, material alba, or bio film from the tooth surface or below the gingival margin, or any other material or debris therein, and further provide an absorbent interface that may be used to deliver desired pharmacologic or other active agents to the targeted interdental space.

Various other embodiments of the present invention permit the use of the delivery or application of positive or negative gas pressure through the interdental cleaner and the one or more porous interfaces to permit further displacement and/or removal of dental plaque, material alba, or bio film from the tooth surface or below the gingival margin, or any other material or debris within the interdental space or adjacent gum or tooth surfaces.

Figure 1A:
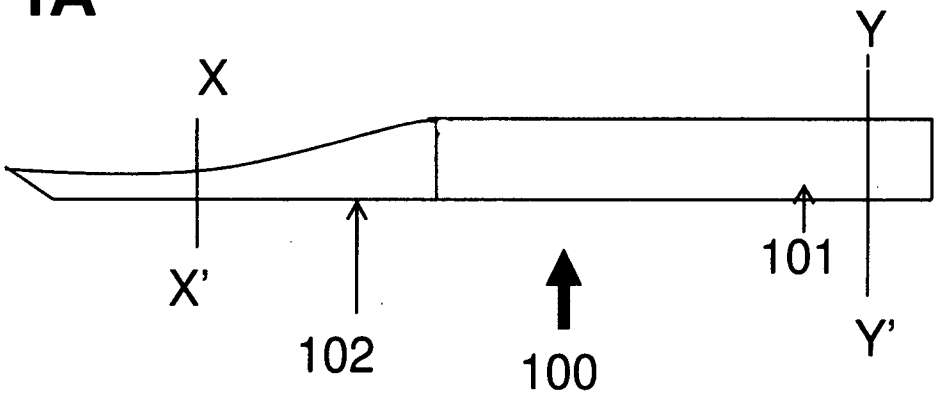
FIG. 1A is a side perspective view of an exemplary embodiment of an interdental cleaner of the present invention.

Referring now to FIG. 1A, one exemplary embodiment interdental cleaner 100 of the present invention is shown, comprising a handle 101 and an interdental body 102. The handle 101 may be constructed of any plastic or other polymer, or the handle 101 alternately may be fabricated from metals, metal alloys, wood, glasses, ceramics, or composites of any of the foregoing or other materials. In preferred embodiments of the present invention, the handle 101 is constructed of high durometer semi-rigid or rigid commercially available polymer or plastic resins, including but not limited to, polyethylene, polystyrene. PVC, HDPE, polypropylene, ABS/PVC alloys, and various elastomers, such as acetal, Santoprene, nylon and glass-filled ABS. In preferred embodiments of the present invention, the handle 101 may be fabricated by any extrusion, molding, injection molding, machining, or other manufacturing process.

Figure 1B:
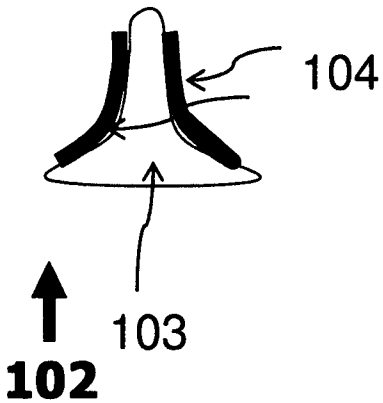
FIG. 1B is a cross-sectional view of an exemplary embodiment of an interdental cleaner of the present invention through the points X-X' on FIG. 1A.
Figure 1C:
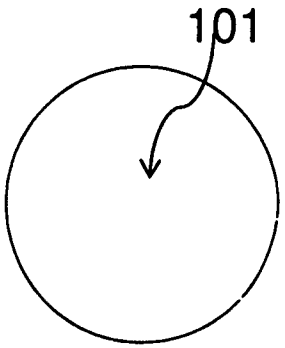
FIG. 1C is a cross-sectional view of an exemplary embodiment of an interdental cleaner of the present invention through the points Y-Y' on FIG. 1A.

In various embodiments according to the present invention, the cross-sectional shape of the handle 101 at the level of the points Y-Y' from FIG. 1A as shown in FIG. 1C may be round. In various other embodiments according to the present invention, the cross-sectional shape of the handle 101 may be triangular, elliptical, rectangular, squared, polygonal, or any shape, with or without edges, to provide a desired ergonomic interface for a user.

In various embodiments according to the present invention, the interdental body 102 may be a continuous structural extension of the handle 101, or the interdental body 102 may be a separate structural element that is cemented, bonded, secured, or otherwise attached to the handle 101.

In those various embodiments according to the present invention in which the interdental body 102 may be a structural element separate from but attached to the handle 101, the interdental body 102 may be constructed of any plastic or other polymer, co-polymer, or blend, or the interdental body 102 alternately may be fabricated from metals, metal alloys, wood, glasses, ceramics, or composites of any of the foregoing or other materials. In preferred embodiments of the present invention, the interdental body 102 is constructed of semi-rigid or rigid commercially available polymer or plastic resins, including but not limited to, polyethylene, polystyrene. PVC, HDPE, polypropylene, ABS/PVC alloys, and various elastomers, such as acetal, Santoprene, nylon and glass-filled ABS.

Preferred semi-rigid plastics or polymers in the various embodiments of the present invention include those plastics and polymers with a modulus of elasticity, either in flexure or in tension, between 700 and 7000 Kg per sq cm (10,000 and 100,000 psi) at 23° C. and 50% relative humidity. Preferred semi-rigid plastics or polymers in the various embodiments of the present invention include those plastics and polymers with durometer measurements in the range of about 30 to about 100 on the ASTM D2240 type A scale.

In various preferred embodiments of the present invention, the interdental body 102 is constructed of polymers or plastics of lower durometer than those of the associated handle 101. In preferred embodiments of the present invention, the interdental body 102 may be fabricated by any extrusion, molding, injection molding, machining, or other manufacturing process.

FIG. 1A shows the interdental body 102 to be a tapering element terminating in a tapered and angled manner for access to small spaces. In various preferred embodiments of the present invention, the interdental body 102 may be tapered, non-tapered, and may terminate in a blunted, rounded, tapered, non-tapered, angled, or non-angled manner.

Referring now to FIG. 1B which shows a cross-sectional view through the points X-X' on FIG. 1A, the interdental body 102 is shown to comprise a base member 103 and one or more porous interfaces 104. In various embodiments according to the present invention, the base member 103 may be a structural element separate from but attached to the interdental body 102, the base member 103 may be constructed of any plastic or other polymer, co-polymer, or blend, or the base member 103 alternately may be fabricated from metals, metal alloys, wood, glasses, papers, ceramics, or composites of any of the foregoing or other materials. In preferred embodiments of the present invention, the base member 103 is constructed of semi-rigid or rigid commercially available polymer or plastic resins, including but not limited to, polyethylene, polystyrene. PVC, HDPE, polypropylene, ABS/PVC alloys, and various elastomers, such as acetal, Santoprene, nylon and glass-filled ABS.

In various embodiments according to the present invention, the cross-sectional shape of the base member 103 as shown in FIG. 1B may be a triangular form with rounded edges. In various other embodiments according to the present invention, the cross-sectional shape of the base member 103 may be triangular, elliptical, rectangular, squared, polygonal, or any shape, with or without edges. As shown in FIG. 1B, the interdental body 102 has a shape analogous to the anatomic configuration of the inter-proximal area in and between the teeth. In various preferred embodiments of the present invention, the interdental body 102 and base member 103 are optimally shaped and provided to be extended under orthodontic appliances and fixed bridge work on teeth and dental implants.

In various embodiments according to the present invention, the base member 103 as shown in FIG. 1B may be covered in whole or in part by one or more porous interfaces 104. The porous interfaces 104 in various embodiments according to the present invention may be constructed of any commercially available polymer or plastic resins, including but not limited to, Ultra High Molecular Weight Polyethylene (UHMWPE), High Density Polyethylene (HDPE), Low Density Polyethylene (LDPE), Very Low Density Polyethylene (VLDPE), Polypropylene (PP), Ethylene Vinyl Acetate (EVA), Polystyrene (PS), Epoxy Glass, and Phenol Glass, or co-polymers, co-extrusions, or blends thereof. In certain preferred embodiments of the present invention, the porous interfaces 104 may comprise microfiber woven or non-woven materials. In various preferred embodiments of the present invention, the porous interfaces 104 may further comprise hypoallergenic materials. In various preferred embodiments of the present invention, the porous interfaces 104 may further comprise hydrophobic materials; in other various preferred embodiments of the present invention, the porous interfaces 104 may further comprise hydrophilic materials.

Furthermore, the porous interfaces 104 in various embodiments according to the present invention may be constructed as single layer materials or as multi-layer structures. The porous interfaces 104 in various embodiments according to the present invention may further be provided as woven, non-woven, molded, extruded, sponge-like, or solid materials with a porous surface quality. Further still, the porous interfaces 104 in various embodiments according to the present invention may further be constructed of conventional or microfiber materials that are not limited in material fiber and include synthetic fibers such as olefin including polyethylene and polypropylene, polyester, polyamide, and like materials, reclaimed fibers such as rayon, dacron, nylon, teflon, and the like, and natural fibers such as cotton and like materials, for example. In addition, those materials are not limited in manufacturing method and include nonwoven materials manufactured by publicly known processing methods such as a spun lace method, a spun bond method, a thermal bond method, a melt-blown method, a needle punch method and like methods. In addition, woven or mesh materials may be employed, using molded meshes, or woven meshes or fabrics using conventional weaving, spinning, or electrospinning techniques.

In various embodiments according to the present invention, the one or more porous interfaces 104 may be attached to the base member 103 in whole or in part by welding, melding, thermal shrinkage, lamination, or by use of various conventional glues, adhesives, or other cements. Alternately, in certain embodiments according to the present invention, the one or more porous interfaces 104 may be dually extruded with the base member 103 during manufacture.

The advantages and purposes of the porous interfaces 104 in various embodiments according to the present invention may include, but are not limited to, providing a gentle but minimally abrasive contact surface for interdental mechanical cleaning, providing an absorbent cleaning surface at the interdental interface to allow removal of dental plaque, material alba, or bio film on the tooth surface or below the gingival margin, or any other material or other debris therein, and further providing an absorbent interface that may be used to deliver desired pharmacologic or other active agents including, but not limited to, antibiotics, antiseptics, anesthetics, and astringents, to the targeted interdental space. For example, an interdental cleaner 100 according to the present invention may be used as an inter-proximal delivery system for whitening rinses and gels, as well as antimicrobial and fluoride oral rinses to the teeth and surrounding gingival tissues. In various embodiments of the present invention, such desired pharmacologic or other active agents may be applied to the porous interfaces 104 at the time of delivery, or the interdental cleaner 100 may be manufactured and provided with such desired pharmacologic or other active agents in a ready for use manner.

Figure 2A:
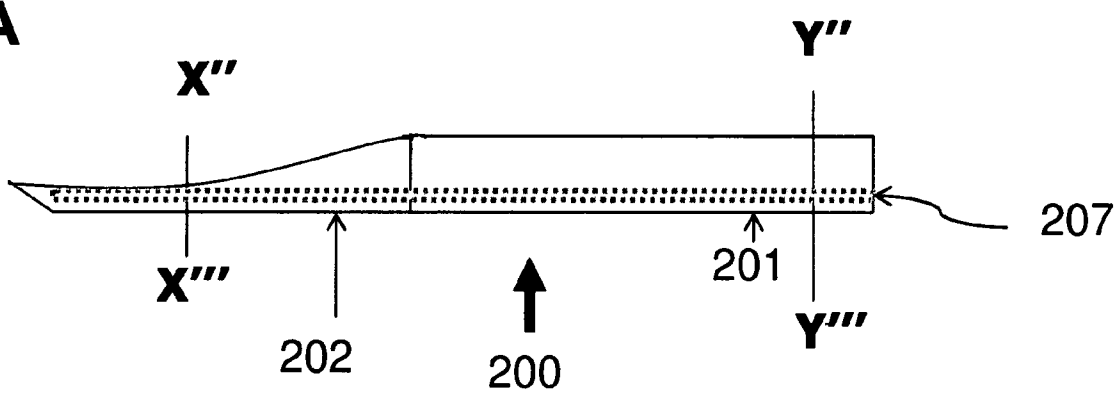
FIG. 2A is a side perspective view of an exemplary embodiment of an interdental cleaner of the present invention.

Referring now to FIG. 2A, one exemplary embodiment interdental cleaner 200 of the present invention is shown, comprising a handle 201 and an interdental body 202. As shown in FIG. 2A, the handle 201 and interdental body 202 further comprise a longitudinally continuous lumen 207. In various embodiments of the present invention, the longitudinally continuous lumen 207 may terminate in a blind end within the interdental body 202, or alternately may extend fully therethrough. Not shown in FIG. 2A, the longitudinally continuous lumen 207 may further be provided with a connector or port at or near its origin in the handle 201 to allow its connection to external injection and/or negative pressure sources. The handle 201 may be constructed of any plastic or other polymer, or the handle 201 alternately may be fabricated from metals, metal alloys, wood, glasses, ceramics, or composites of any of the foregoing or other materials. In preferred embodiments of the present invention, the handle 201 is constructed of high durometer semi-rigid or rigid commercially available polymer or plastic resins, including but not limited to, polyethylene, polystyrene. PVC, HDPE, polypropylene, ABS/PVC alloys, and various elastomers, such as acetal, Santoprene, nylon and glass-filled ABS. In preferred embodiments of the present invention, the handle 201 and longitudinally continuous lumen 207 may be fabricated by any extrusion, molding, injection molding, machining, or other manufacturing process.

Figure 2B:
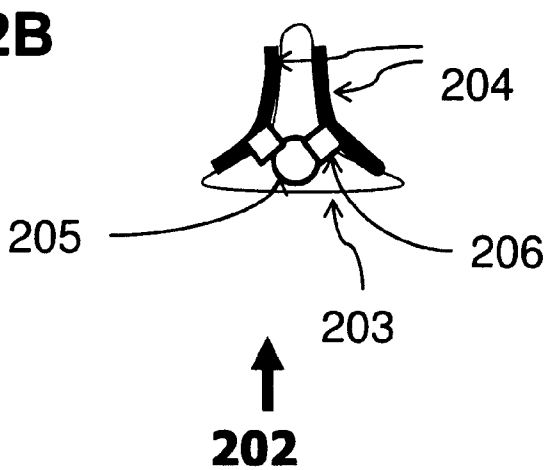
FIG. 2B is a cross-sectional view of an exemplary embodiment of an interdental cleaner of the present invention through the points X"-X'" on FIG. 2A.
Figure 2C:
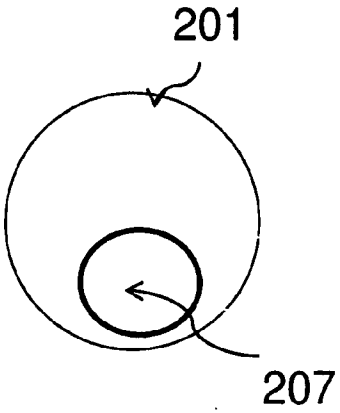
FIG. 2C is a cross-sectional view of an exemplary embodiment interdental cleaner of the present invention through the points Y"-Y'" on FIG. 2A.

In various embodiments according to the present invention, the cross-sectional shape of the handle 201 at the level of the points Y"-Y"' from FIG. 2A as shown in FIG. 2C may be round. As shown in FIG. 2C, the longitudinally continuous lumen 207 is located in an off-center position to allow its continuous location in the tapered interdental body 202 as shown in the exemplary embodiment of FIG. 2A. In various other embodiments according to the present invention, the cross-sectional shape of the handle 201 may be triangular, elliptical, rectangular, squared, polygonal, or any shape, with or without edges, to provide a desired ergonomic interface for a user.

In various embodiments according to the present invention, the interdental body 202 may be a continuous structural extension of the handle 201, or the interdental body 202 may be a separate structural element that is cemented, bonded, secured, or otherwise attached to the handle 201.

In those various embodiments according to the present invention in which the interdental body 202 may be a structural element separate from but attached to the handle 201, the interdental body 202 may be constructed of any plastic or other polymer, co-polymer, or blend, or the interdental body 202 alternately may be fabricated from metals, metal alloys, wood, glasses, ceramics, or composites of any of the foregoing or other materials. In preferred embodiments of the present invention, the interdental body 202 is constructed of semi-rigid or rigid commercially available polymer or plastic resins, including but not limited to, polyethylene, polystyrene. PVC, HDPE, polypropylene, ABS/PVC alloys, and various elastomers, such as acetal, Santoprene, nylon and glass-filled ABS.

Preferred semi-rigid plastics or polymers in the various embodiments of the present invention include those plastics and polymers with a modulus of elasticity, either in flexure or in tension, between 700 and 7000 Kg per sq cm (10,000 and 100,000 psi) at 23° C. and 50% relative humidity. Preferred semi-rigid plastics or polymers in the various embodiments of the present invention include those plastics and polymers with durometer measurements in the range of about 30 to about 100 on the ASTM D2240 type A scale.

In various preferred embodiments of the present invention, the interdental body 202 is constructed of polymers or plastics of lower durometer than those of the associated handle 201. In preferred embodiments of the present invention, the interdental body 202 and longitudinally continuous lumen 207 may be fabricated by any extrusion, molding, injection molding, machining, or other manufacturing process.

FIG. 2A shows the interdental body 202 to be a tapering element terminating in a tapered and angled manner for access to small spaces. In various preferred embodiments of the present invention, the interdental body 202 may be tapered, non-tapered, and may terminate in a blunted, rounded, tapered, non-tapered, angled, or non-angled manner.

Referring now to FIG. 2B which shows a cross-sectional view through the points X"-X'" on FIG. 2A, the interdental body 202 is shown to comprise a base member 203 and one or more porous interfaces 204. In addition, FIG. 2B shows the longitudinally continuous lumen 207 and the presence of one or more interconnecting ports 206 that connect the longitudinally continuous lumen 207 with the one or more porous interfaces 204. In various embodiments according to the present invention, the base member 203 may be a structural element separate from but attached to the interdental body 202, the base member 203 may be constructed of any plastic or other polymer, co-polymer, or blend, or the base member 203 alternately may be fabricated from metals, metal alloys, wood, glasses, papers, ceramics, or composites of any of the foregoing or other materials. In preferred embodiments of the present invention, the base member 203 is constructed of semi-rigid or rigid commercially available polymer or plastic resins, including but not limited to, polyethylene, polystyrene. PVC, HDPE, polypropylene, ABS/PVC alloys, and various elastomers, such as acetal, Santoprene, nylon and glass-filled ABS.

In various embodiments according to the present invention, the cross-sectional shape of the base member 203 as shown in FIG. 2B may be a triangular form with rounded edges. In various other embodiments according to the present invention, the cross-sectional shape of the base member 203 may be triangular, elliptical, rectangular, squared, polygonal, or any shape, with or without edges. As shown in FIG. 2B, the interdental body 202 has a shape analogous to the anatomic configuration of the inter-proximal area in and between the teeth. In various preferred embodiments of the present invention, the interdental body 202 and base member 203 are optimally shaped and provided to be extended under orthodontic appliances and fixed bridge work on teeth and dental implants.

In various embodiments according to the present invention, the base member 203 as shown in FIG. 2B may be covered in whole or in part by one or more porous interfaces 204. The porous interfaces 204 in various embodiments according to the present invention may be constructed of any commercially available polymer or plastic resins, including but not limited to, Ultra High Molecular Weight Polyethylene (UHMWPE), High Density Polyethylene (HDPE), Low Density Polyethylene (LDPE), Very Low Density Polyethylene (VLDPE), Polypropylene (PP), Ethylene Vinyl Acetate (EVA), Polystyrene (PS), Epoxy Glass, and Phenol Glass, or co-polymers, co-extrusions, or blends thereof. In certain preferred embodiments of the present invention, the porous interfaces 204 may comprise microfiber woven or non-woven materials. In various preferred embodiments of the present invention, the porous interfaces 204 may further comprise hypoallergenic materials. In various preferred embodiments of the present invention, the porous interfaces 204 may further comprise hydrophobic materials; in other various preferred embodiments of the present invention, the porous interfaces 204 may further comprise hydrophilic materials.

Furthermore, the porous interfaces 204 in various embodiments according to the present invention may be constructed as single layer materials or as multi-layer structures. The porous interfaces 204 in various embodiments according to the present invention may further be provided as woven, non-woven, molded, extruded, sponge-like, or solid materials with a porous surface quality. Further still, the porous interfaces 204 in various embodiments according to the present invention may further be constructed of conventional or microfiber materials that are not limited in material fiber and include synthetic fibers such as olefin including polyethylene and polypropylene, polyester, polyamide, and like materials, reclaimed fibers such as rayon, dacron, nylon, teflon, and the like, and natural fibers such as cotton and like materials, for example. In addition, those materials are not limited in manufacturing method and include nonwoven materials manufactured by publicly known processing methods such as a spun lace method, a spun bond method, a thermal bond method, a melt-blown method, a needle punch method and like methods. In addition, woven or mesh materials may be employed, using molded meshes, or woven meshes or fabrics using conventional weaving, spinning, or electrospinning techniques.

In various embodiments according to the present invention, the one or more porous interfaces 204 may be attached to the base member 203 in whole or in part by welding, melding, thermal shrinkage, lamination, or by use of various conventional glues, adhesives, or other cements. Alternately, in certain embodiments according to the present invention, the one or more porous interfaces 204 may be dually extruded with the base member 203 during manufacture.

The advantages and purposes of the porous interfaces 204 in various embodiments according to the present invention as shown in FIG. 2A-C may include, but are not limited to, providing a gentle but minimally abrasive contact surface for interdental mechanical cleaning, providing an absorbent cleaning surface at the interdental interface to allow removal of dental plaque, material alba, or bio film on the tooth surface or below the gingival margin, or any other material or other debris therein, and providing an absorbent interface that may be used to deliver desired pharmacologic or other active agents to the targeted interdental space, and providing a means through the longitudinally continuous lumen 207 of either instilling such desired pharmacologic or other active agents and/or a means of applying negative or positive pressure to the porous interfaces 204 to further aid in cleaning those spaces of debris or plaque.

For example, the longitudinally continuous lumen 207 of an interdental cleaner 200 according to the present invention may be used as an inter-proximal delivery system for whitening rinses and gels, as well as antimicrobial and fluoride oral rinses to the teeth and surrounding gingival tissues. In various embodiments of the present invention, the longitudinally continuous lumen 207 may be connected to an external source in order that such desired pharmacologic or other active agents including, but not limited to, antibiotics, antiseptics, anesthetics, and astringents, may be delivered to the porous interfaces 204 through the one or more interconnecting ports 206 at the time of delivery, or the interdental cleaner 200 may be manufactured and provided with an internal supply source [not shown in FIGS. 2A-C] of such desired pharmacologic or other active agents that may be dispensed though the interdental lumen 205, which is an extension of the longitudinally continuous lumen 207 in a ready for use manner. The interdental lumen 205 refers to that more distal portion of the longitudinally continuous lumen 207 within the interdental body 202 that contains the branching one or more interconnecting ports 206.

As a further example, the longitudinally continuous lumen 207 of an interdental cleaner 200 according to the present invention may be used as a means of delivering positive or negative gas pressure from an external source [not shown in FIGS. 2A-2C] to the porous interfaces 204, thus allowing to displace and/or attract and retain plaque and debris from the interdental spaces for enhanced cleaning effects.

FIGS. 3A-3H shows a variety of alternate cross-sectional views that correspond to those of FIGS. 1B and 2B in various alternative embodiments of interdental bodies of the present invention. The alternate embodiments shown in FIGS. 3A-3H differ primarily in their cross-sectional shapes, and address alternate considerations in providing an optimal cleaning shape and surface for interdental cleaners according to the present invention.

Figure 3B:
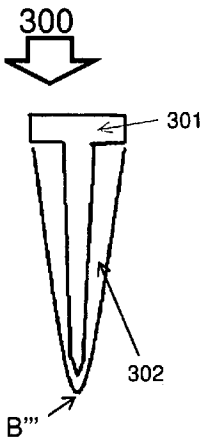
FIGS. 3A-3D show cross-sectional views of various exemplary embodiments of interdental cleaners of the present invention in which the base members are solid.
Figure 3D:
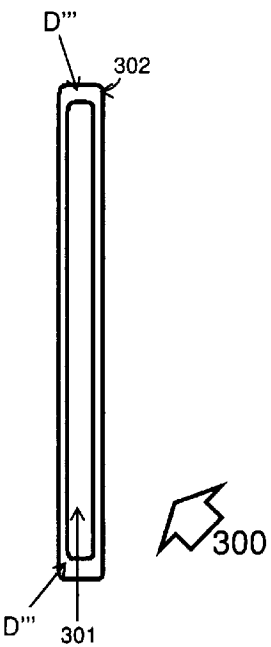
Figure 3A:
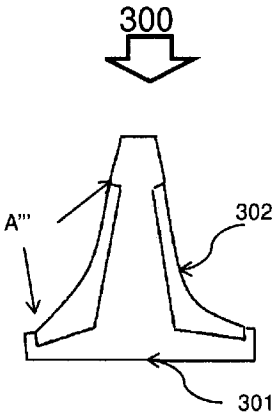
Figure 3C:
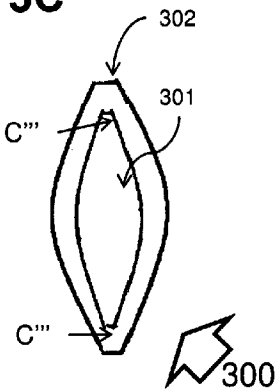
Figure 3F:
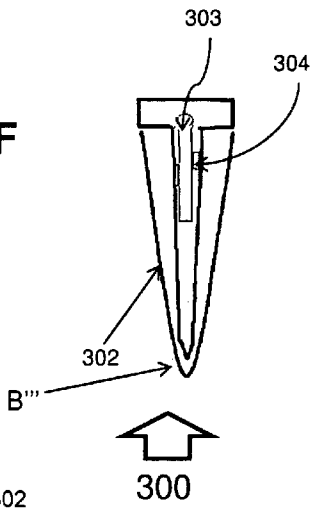
FIGS. 3E-3H show cross-sectional views of various exemplary embodiments of interdental cleaners of the present invention in which the base members are provided with centrally continuous lumens.
Figure 3H:
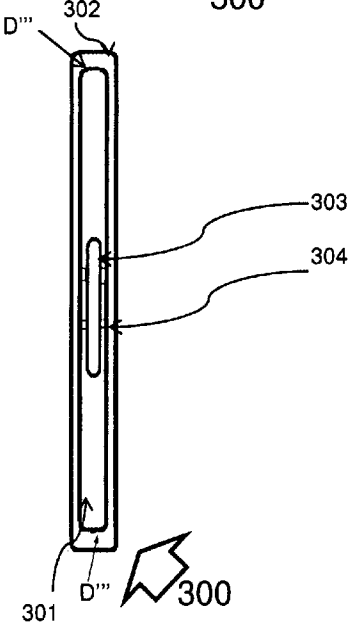
Figure 3E:
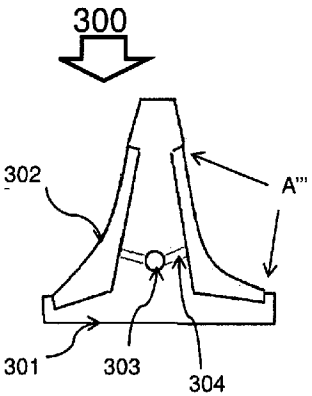

FIGS. 3A and 3E each show a generally blunted triangular cross-sectional shaped interdental body 300 comprising a base member 301 and one or more porous interfaces 302. In addition, FIG. 3E shows a longitudinally continuous lumen 303 and the presence of one or more interconnecting ports 304 that connect the longitudinally continuous lumen 303 with the one or more porous interfaces 302. In various embodiments according to the present invention, the base member 301 may be a structural element separate from but attached to the interdental body 300. The base member 301 may be constructed of any plastic or other polymer, co-polymer, or blend, or the base member 301 alternately may be fabricated from metals, metal alloys, wood, glasses, papers, ceramics, or composites of any of the foregoing or other materials. In preferred embodiments of the present invention, the base member 301 is constructed of semi-rigid or rigid commercially available polymer or plastic resins, including but not limited to, polyethylene, polystyrene. PVC, HDPE, polypropylene, ABS/PVC alloys, and various elastomers, such as acetal, Santoprene, nylon and glass-filled ABS.

In FIGS. 3A and 3E, the one or more porous interfaces 302 are located within a recessed trough in the base member 301, such that there is no ridge or lip formed at the surface junctions of the one or more porous interfaces 302 and the base member 301 at the points A'''. This is designed to minimize local tissue trauma and better fit the interdental spaces. The features and functions of the interdental body 300 of FIGS. 3A and 3E are otherwise identical to the corresponding structures of FIGS. 1A-1C and FIGS. 2A-2C.

In FIGS. 3B and 3F, a more wedge-shaped cross-sectional shape is provided, in which the one or more porous interfaces 302 is shown as a continuous covering overlapping the edge of the base member 301 at the point B'''. In addition, FIG. 3F shows a longitudinally continuous lumen 303 and the presence of one or more interconnecting ports 304 that connect the longitudinally continuous lumen 303 with the one or more porous interfaces 302. The features and functions of the interdental body 300 of FIGS. 3B and 3F are otherwise identical to the corresponding structures of FIGS. 1A-1C and FIGS. 2A-2C.

Figure 3G:
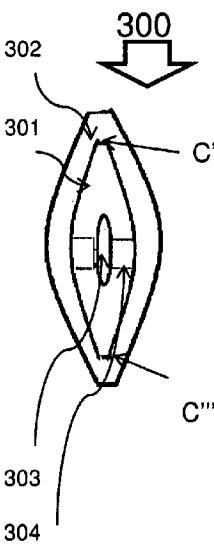

In FIGS. 3C and 3G, a more elliptical-shaped cross-sectional shape is provided, in which the one or more porous interfaces 302 is shown as a continuous covering overlapping the edges of the base member 301 at the points C'''. In addition, FIG. 3G shows a longitudinally continuous lumen 303 and the presence of one or more interconnecting ports 304 that connect the longitudinally continuous lumen 303 with the one or more porous interfaces 302. The features and functions of the interdental body 300 of FIGS. 3C and 3G are otherwise identical to the corresponding structures of FIGS. 1A-1C and FIGS. 2A-2C.

In FIGS. 3D and 3H, a more band-shaped cross-sectional shape is provided, in which the one or more porous interfaces 302 is shown as a continuous covering overlapping the edges of the base member 301 at the points D'''. In addition, FIG. 3H shows a longitudinally continuous lumen 303 and the presence of one or more interconnecting ports 304 that connect the longitudinally continuous lumen 303 with the one or more porous interfaces 302. The features and functions of the interdental body 300 of FIGS. 3D and 3H are otherwise identical to the corresponding structures of FIGS. 1A-1C and FIGS. 2A-C.

In various embodiments according to the present invention, the base member 301 as shown in FIGS. 3A-3H may be covered in whole or in part by one or more porous interfaces 302. The porous interfaces 302 in various embodiments according to the present invention may be constructed of any commercially available polymer or plastic resins, including but not limited to, Ultra High Molecular Weight Polyethylene (UHMWPE), High Density Polyethylene (HDPE), Low Density Polyethylene (LDPE), Very Low Density Polyethylene (VLDPE), Polypropylene (PP), Ethylene Vinyl Acetate (EVA), Polystyrene (PS), Epoxy Glass, and Phenol Glass, or co-polymers, co-extrusions, or blends thereof. In certain preferred embodiments of the present invention, the porous interfaces 302 may comprise microfiber woven or non-woven materials. In various preferred embodiments of the present invention, the porous interfaces 302 may further comprise hypoallergenic materials. In various preferred embodiments of the present invention, the porous interfaces 302 may further comprise hypoallergenic materials. In various preferred embodiments of the present invention, the porous interfaces 302 may further comprise hydrophobic materials; in other various preferred embodiments of the present invention, the porous interfaces 302 may further comprise hydrophilic materials.

Furthermore, the porous interfaces 302 in various embodiments according to the present invention may be constructed as single layer materials or as multi-layer structures. The porous interfaces 302 in various embodiments according to the present invention may further be provided as woven, non-woven, molded, extruded, sponge-like, or solid materials with a porous surface quality. Further still, the porous interfaces 302 in various embodiments according to the present invention may further be constructed of conventional or microfiber materials that are not limited in material fiber and include synthetic fibers such as olefin including polyethylene and polypropylene, polyester, polyamide, and like materials, reclaimed fibers such as rayon, dacron, nylon, teflon, and the like, and natural fibers such as cotton and like materials, for example. In addition, those materials are not limited in manufacturing method and include nonwoven materials manufactured by publicly known processing methods such as a spun lace method, a spun bond method, a thermal bond method, a melt-blown method, a needle punch method and like methods. In addition, woven or mesh materials may be employed, using molded meshes, or woven meshes or fabrics using conventional weaving, spinning, or electrospinning techniques.

In various embodiments according to the present invention, the one or more porous interfaces 302 may be attached to the base member 301 in whole or in part by welding, melding, thermal shrinkage, lamination, or by use of various conventional glues, adhesives, or other cements. Alternately, in certain embodiments according to the present invention, the one or more porous interfaces 302 may be dually extruded with the base member 301 during manufacture.

The advantages and purposes of the porous interfaces 302 in various embodiments according to the present invention as shown in FIGS. 3A-3H may include, but are not limited to, providing a gentle but minimally abrasive contact surface for interdental mechanical cleaning, providing an absorbent cleaning surface at the interdental interface to allow removal of dental plaque, material alba, or bio film on the tooth surface or below the gingival margin, or any other material or other debris therein, and providing an absorbent interface that may be used to deliver desired pharmacologic or other active agents to the targeted interdental space, and providing a means through the longitudinally continuous lumen 303 (in FIGS. 3E, 3F, 3G, and 3H) of either instilling such desired pharmacologic or other active agents and/or a means of applying negative or positive pressure to the porous interfaces 302 to further aid in cleaning those spaces of debris or plaque.

Figure 4A:
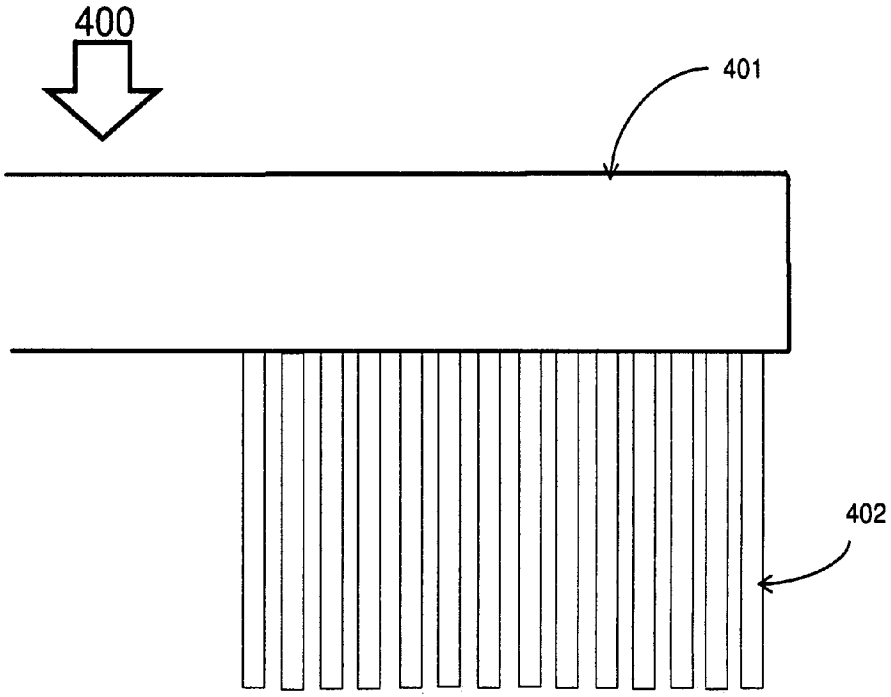
FIG. 4A is a side perspective view of an exemplary toothbrush embodiment of an interdental cleaner of the present invention.

FIG. 4A is a lateral view of a toothbrush embodiment of the present invention, showing a toothbrush 400 comprising a body 401 with imbedded or attached porous bristles 402. The toothbrush body 401 is shown only in its distal tip in FIG. 4A, and may be constructed of any known material including but not limited to, any plastic or other polymer, metals, metal alloys, wood, glasses, ceramics, or composites of any of the foregoing or other materials. In preferred embodiments of the present invention, the toothbrush body 401 is constructed of high durometer semi-rigid or rigid commercially available polymer or plastic resins, including but not limited to, polyethylene, polystyrene. PVC, HDPE, polypropylene, ABS/PVC alloys, and various elastomers, such as acetal, Santoprene, nylon and glass-filled ABS. In preferred embodiments of the present invention, the toothbrush body 401 may be fabricated by any extrusion, molding, injection molding, machining, or other manufacturing process.

Figure 4B:
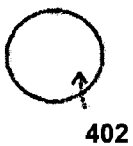
FIG. 4B is a cross-sectional view of an exemplary embodiment of a porous bristle of the exemplary toothbrush embodiment of an interdental cleaner of the present invention shown in FIG. 4A.

The porous bristles 402 of the toothbrush 400 may be imbedded in or otherwise attached to the toothbrush body 401 using conventional manufacturing processes. In various embodiments according to the present invention, the porous bristles 402 may comprise entirely porous structures as shown in FIG. 4B, or the porous component may be provided as a porous bristle covering 403 for a solid or tubular bristle core 404 as shown in FIG. 4C.

In various embodiments according to the present invention, the porous bristles 402 or porous bristle covering 403 in various embodiments according to the present invention may be constructed of any commercially available polymer or plastic resins, including but not limited to, Ultra High Molecular Weight Polyethylene (UHMWPE), High Density Polyethylene (HDPE), Low Density Polyethylene (LDPE), Very Low Density Polyethylene (VLDPE), Polypropylene (PP), Ethylene Vinyl Acetate (EVA), Polystyrene (PS), Epoxy Glass, and Phenol Glass, or co-polymers, co-extrusions, or blends thereof. In certain preferred embodiments of the present invention, the porous bristles 402 or porous bristle covering 403 may comprise microfiber woven or non-woven materials. In various preferred embodiments of the present invention, the porous bristles 402 or porous bristle covering 403 may further comprise hypoallergenic materials. In various preferred embodiments of the present invention, the porous bristles 402 or porous bristle covering 403 may further comprise hypoallergenic materials. In various preferred embodiments of the present invention, the porous bristles 402 or porous bristle covering 403 may further comprise hydrophobic materials; in other various preferred embodiments of the present invention, the porous bristles 402 or porous bristle covering 403 may further comprise hydrophilic materials.

Furthermore, the porous bristles 402 or porous bristle covering 403 in various embodiments according to the present invention may be constructed as single layer materials or as multi-layer structures. The porous bristles 402 or porous bristle covering 403 in various embodiments according to the present invention may further be provided as woven, non-woven, molded, extruded, sponge-like, or solid materials with a porous surface quality. Further still, the porous bristles 402 or porous bristle covering 403 in various embodiments according to the present invention may further be constructed of conventional or microfiber materials that are not limited in material fiber and include synthetic fibers such as olefin including polyethylene and polypropylene, polyester, polyamide, and like materials, reclaimed fibers such as rayon, dacron, nylon, teflon, and the like, and natural fibers such as cotton and like materials, for example. In addition, those materials are not limited in manufacturing method and include nonwoven materials manufactured by publicly known processing methods such as a spun lace method, a spun bond method, a thermal bond method, a melt-blown method, a needle punch method and like methods. In addition, woven or mesh materials may be employed, using molded meshes, or woven meshes or fabrics using conventional weaving, spinning, or electrospinning techniques.

Figure 4C:
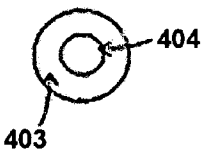
FIG. 4C is a cross-sectional view of an exemplary embodiment of a bristle of the exemplary toothbrush embodiment of an interdental cleaner of the present invention shown in FIG. 4A in which the bristle comprises a porous covering and a solid or tubular core.

In those embodiments of the present invention in which a solid or tubular bristle core 404 is employed as shown in FIG. 4C, the solid or tubular bristle core 404 may be constructed of any natural fiber or synthetic fibers comprising any commercially available polymer or plastic resins, including but not limited to, Ultra High Molecular Weight Polyethylene (UHMWPE), High Density Polyethylene (HDPE), Low Density Polyethylene (LDPE), Very Low Density Polyethylene (VLDPE), Polypropylene (PP), Ethylene Vinyl Acetate (EVA), Polystyrene (PS), Epoxy Glass, and Phenol Glass, or co-polymers, co-extrusions, or blends thereof. Alternately still, the solid or tubular bristle core 404 may be constructed of any metals, metal alloys, fiberglass, or any composites of any aforementioned materials.

The advantages and purposes of the porous bristles 402 in various embodiments of a toothbrush 400 according to the present invention may include, but are not limited to, providing a gentle but minimally abrasive contact surface for interdental mechanical cleaning, providing an absorbent cleaning surface at the interdental interface to allow removal of dental plaque, material alba, or bio film on the tooth surface or below the gingival margin, or any other material or other debris therein, and further providing an absorbent interface that may be used to deliver desired pharmacologic or other active agents to the targeted interdental space. For example, a toothbrush 400 according to the present invention may be used as an inter-proximal delivery system for whitening rinses and gels, as well as antimicrobial and fluoride oral rinses to the teeth and surrounding gingival tissues. In various embodiments of the present invention, such desired pharmacologic or other active agents including, but not limited to, antibiotics, antiseptics, anesthetics, and astringents, may be applied to the porous bristles 402 at the time of delivery, or the toothbrush 400 may be manufactured and provided with such desired pharmacologic or other active agents in a ready for use manner.

FIG. 4D is a lateral view of a toothbrush embodiment of the present invention, showing a toothbrush 400' comprising a body 401' with imbedded or attached porous bristles 407. As shown in FIG. 4D, the body 401' further comprises a longitudinally continuous lumen 405. In various embodiments of the present invention, the longitudinally continuous lumen 405 may terminate in a blind end within the body 401', and may have a branching plurality of bristle ports 406 in direct communication with the longitudinally continuous lumen 405, such that liquids or gas pressure flowing within the longitudinally continuous lumen 405 would flow into the bristle ports 406, where such liquids or pressures would be imparted to the associated porous bristles 407. Not shown in FIG. 4D, the longitudinally continuous lumen 405 may further be provided with a connector or port at or near its origin in the body 401 to allow its connection to external injection and/or negative pressure sources.

The toothbrush body 401' is shown only in its distal tip in FIG. 4D, and may be constructed of any known material including but not limited to, any plastic or other polymer, metals, metal alloys, wood, glasses, ceramics, or composites of any of the foregoing or other materials. In preferred embodiments of the present invention, the toothbrush body 401' is constructed of high durometer semi-rigid or rigid commercially available polymer or plastic resins, including but not limited to, polyethylene, polystyrene. PVC, HDPE, polypropylene, ABS/PVC alloys, and various elastomers, such as acetal, Santoprene, nylon and glass-filled ABS. In preferred embodiments of the present invention, the toothbrush body 401' and longitudinally continuous lumen 405 may be fabricated by any extrusion, molding, injection molding, machining, or other manufacturing process.

The porous bristles 407 of the toothbrush 400' may be imbedded in or otherwise attached to the toothbrush body 401' in direct communication with the bristle ports 406 using conventional manufacturing processes. In various embodiments according to the present invention, the porous bristles 407 may comprise entirely porous structures as shown in FIG. 4E, or the porous component may be provided as a porous bristle covering 408 for a solid or tubular bristle core 411 as shown in FIG. 4F, or the porous bristles 407 may comprise a porous bristle covering 409 for a tubular bristle core 412 with a plurality of bristle ports 413 as shown in FIG. 4G. In embodiments with the latter construction, the bristle ports 413 may provide direct flow path from the lumen of the bristle ports 413 to the exterior surfaces of the porous bristles 407 or the bristle ports 413 may terminate within the interior structure of the porous bristles 407.

In various embodiments according to the present invention, the porous bristles 408 or porous bristle covering 409 in various embodiments according to the present invention may be constructed of any commercially available polymer or plastic resins, including but not limited to, Ultra High Molecular Weight Polyethylene (UHMWPE), High Density Polyethylene (HDPE), Low Density Polyethylene (LDPE), Very Low Density Polyethylene (VLDPE), Polypropylene (PP), Ethylene Vinyl Acetate (EVA), Polystyrene (PS), Epoxy Glass, and Phenol Glass, or co-polymers, co-extrusions, or blends thereof. In certain preferred embodiments of the present invention, the porous bristles 408 or porous bristle covering 409 may comprise microfiber woven or non-woven materials. In various preferred embodiments of the present invention, the porous bristles 408 or porous bristle covering 409 may further comprise hypoallergenic materials. In various preferred embodiments of the present invention, the porous bristles 408 or porous bristle covering 409 may further comprise hydrophobic materials; in other various preferred embodiments of the present invention, the porous bristles porous bristles 408 or porous bristle covering 409 may further comprise hydrophilic materials.

Furthermore, the porous bristles 408 or porous bristle covering 409 in various embodiments according to the present invention may be constructed as single layer materials or as multi-layer structures. The porous bristles 408 or porous bristle covering 409 in various embodiments according to the present invention may further be provided as woven, non-woven, molded, extruded, sponge-like, or solid materials with a porous surface quality. Further still, the porous bristles 408 or porous bristle covering 409 in various embodiments according to the present invention may further be constructed of conventional or microfiber materials that are not limited in material fiber and include synthetic fibers such as olefin including polyethylene and polypropylene, polyester, polyamide, and like materials, reclaimed fibers such as rayon, dacron, nylon, teflon, and the like, and natural fibers such as cotton and like materials, for example. In addition, those materials are not limited in manufacturing method and include nonwoven materials manufactured by publicly known processing methods such as a spun lace method, a spun bond method, a thermal bond method, a melt-blown method, a needle punch method and like methods. In addition, woven or mesh materials may be employed, using molded meshes, or woven meshes or fabrics using conventional weaving, spinning, or electrospinning techniques.

In those embodiments of the present invention in which a solid or tubular bristle core 411 is employed as shown in FIG. 4C, the solid or tubular bristle core 411 may be constructed of any natural fiber or synthetic fibers comprising any commercially available polymer or plastic resins, including but not limited to, Ultra High Molecular Weight Polyethylene (UHMWPE), High Density Polyethylene (HDPE), Low Density Polyethylene (LDPE), Very Low Density Polyethylene (VLDPE), Polypropylene (PP), Ethylene Vinyl Acetate (EVA), Polystyrene (PS), Epoxy Glass, and Phenol Glass, or co-polymers, co-extrusions, or blends thereof. Alternately still, the solid or tubular bristle core 411 may be constructed of any metals, metal alloys, fiberglass, or any composites of any aforementioned materials.

The advantages and purposes of the porous bristles 407 in various embodiments according to the present invention as shown in FIGS. 4D-G may include, but are not limited to, providing a gentle but minimally abrasive contact surface for interdental mechanical cleaning, providing an absorbent cleaning surface at the interdental interface to allow removal of dental plaque, material alba, or bio film on the tooth surface or below the gingival margin, or any other material or other debris therein, and providing an absorbent interface that may be used to deliver desired pharmacologic or other active agents to the targeted interdental space, and providing a means through the longitudinally continuous lumen 405 of either instilling such desired pharmacologic or other active agents and/or a means of applying negative or positive pressure to the porous bristles 407 to further aid in cleaning those spaces of debris or plaque.

In FIGS. 4A-4G herein, the porous bristles 407 are shown as rounded structures in exemplary embodiments of the present invention. The present invention, however, is not limited to any specific cross-sectional shape for the porous bristles 407. In various other embodiments of the present invention, the porous bristles 407 may be rounded, elliptical, triangular, rectangular, square, polygonal, irregular, or any other geometric configuration in their cross-sectional shapes.

For example, the longitudinally continuous lumen 405 of a toothbrush 400 according to the present invention may be used as an inter-proximal delivery system for whitening rinses and gels, as well as antimicrobial and fluoride oral rinses to the teeth and surrounding gingival tissues. In various embodiments of the present invention, the longitudinally continuous lumen 405 may be connected to an external source in order that such desired pharmacologic or other active agents including, but not limited to, antibiotics, antiseptics, anesthetics, and astringents, may be delivered to the porous bristles 407 through the one or more bristle ports 406 at the time of delivery, or the toothbrush 400 may be manufactured and provided with an internal supply source [not shown in FIGS. 4D-G] of such desired pharmacologic or other active agents that may be dispensed though the longitudinally continuous lumen 405 in a ready for use manner.

As a further example, the longitudinally continuous lumen 405 of a toothbrush 400 according to the present invention may be used as a means of delivering positive or negative pressure from an external source [not shown in FIGS. 4D-G] to the porous bristles 407, thus allowing to displace and/or attract and retain plaque and debris from the interdental spaces for enhanced cleaning effects.

The descriptions of the various exemplary embodiments of the present invention as presented herein are not to be construed in any way as imposing limitations upon the scope thereof. On the contrary, it is to be clearly understood that resort can be had to various other aspects, embodiments, modifications, and equivalents thereof which, after reading the description herein, can suggest themselves to one of ordinary skill in the art without departing from the spirit of the present invention or the scope of the appended claims.

Further, it is to be understood that this invention is not limited to specific materials, agents, or other compounds used and disclosed in the invention described herein, including in the following examples, as each of these can vary. It is also to be understood that the terminology used herein is for the purpose of describing particular aspects or embodiments and is not intended to be limiting. Should the usage or terminology used in any reference that is incorporated by reference conflict with the usage or terminology used in this disclosure, the usage and terminology of this disclosure controls.

Although the foregoing examples of embodiments of the present invention have been described in some detail by way of illustration and example for purposes of clarity and understanding, it will be apparent to those skilled in the art that certain changes and modifications may be practiced within the spirit and scope of the present invention. Therefore, the description and examples presented herein should not be construed to limit the scope of the present invention, the essential features of which are set forth in the appended claims.

I claim:

1. An interdental cleaner comprising a handle, an interdental body extending from the handle and having a narrow-base isosceles triangular cross-section thereby having two sides wider than a third side, a porous interface disposed on the outer surface of each of the wider sides of the interdental body and not on the third side, and a continuous lumen extending longitudinally substantially the length of said handle and said interdental body and operably connected by one or more interconnecting ports to the porous interface, wherein said interdental body is configured for access to the anatomic interproximal area between adjacent teeth, wherein the porous interfaces comprise microfiber surfaces or a plurality of porous bristles.

2. The interdental cleaner of claim 1, wherein said porous interfaces are configured for the removal of dental plaque or other debris from an interdental surface of a tooth.

3. The interdental cleaner of claim 1, wherein said interdental body is flexible.

4. The interdental cleaner of claim 1, wherein said porous interfaces are microfiber surfaces.

5. The interdental cleaner of claim 1, wherein said porous interfaces are each a plurality of porous bristles, and wherein said continuous lumen operably connects to said pluralities of porous bristles.

* * * * *